US010883809B1

(12) United States Patent
Neeb et al.

(10) Patent No.: US 10,883,809 B1
(45) Date of Patent: Jan. 5, 2021

(54) MUZZLE VELOCITY CORRECTION

(71) Applicant: U.S. Government as Represented by the Secretary of the Army, Dover, NJ (US)

(72) Inventors: Alexander Neeb, Flanders, NJ (US); Stephen Ginetto, Blairstown, NJ (US); Andrew Surowiec, Morristown, NJ (US)

(73) Assignee: U.S. Government as Represented by the Secretary of the Army, Washington, DC (US)

( * ) Notice: Subject to any disclaimer, the term of this patent is extended or adjusted under 35 U.S.C. 154(b) by 58 days.

(21) Appl. No.: 16/405,007

(22) Filed: May 7, 2019

(51) Int. Cl.
*F42C 11/06* (2006.01)
*F42B 12/20* (2006.01)

(52) U.S. Cl.
CPC ..... *F42C 11/065* (2013.01); *F42B 12/202* (2013.01)

(58) Field of Classification Search
CPC ..... F42C 11/065; F42B 12/202
USPC ..... 102/215, 206, 216, 246, 275.9, 275.11
See application file for complete search history.

(56) References Cited

U.S. PATENT DOCUMENTS 3,793,890 A 2/1974 Anderson
3,851,531 A 12/1974 White
4,375,192 A 3/1983 Yates
4,694,752 A * 9/1987 Titus ..... F42C 11/06 102/215
5,750,918 A * 5/1998 Mangolds ..... F41H 13/0006 102/213
5,814,755 A * 9/1998 Boss ..... F42C 17/04 89/6.5
5,827,958 A * 10/1998 Sigler ..... F42C 17/04 73/167
5,834,675 A * 11/1998 Boss ..... F42C 17/04 89/6.5
6,216,595 B1 * 4/2001 Lamorlette ..... F41G 7/30 102/200
6,310,335 B1 * 10/2001 Bonnet ..... F42B 10/50 244/3.1
6,345,785 B1 * 2/2002 Harkins ..... F42B 10/48 244/3.1
6,427,598 B1 * 8/2002 Boss ..... F42C 17/04 102/264
6,484,115 B1 * 11/2002 Freymond ..... F42C 11/065 702/104
6,959,893 B1 * 11/2005 Sadowski ..... F42B 10/64 102/305
7,231,519 B2 * 6/2007 Joseph ..... H04L 9/0894 713/171
7,249,730 B1 * 7/2007 Flippen, Jr. ..... F41G 7/346 244/3.1
9,879,963 B2 1/2018 Sullivan
10,113,846 B2 * 10/2018 Pitre ..... F42B 5/28
10,527,425 B1 * 1/2020 Jankowski ..... G01C 21/16

* cited by examiner

*Primary Examiner* — John Cooper
(74) *Attorney, Agent, or Firm* — John P. DiScala

(57) ABSTRACT

A fuze for an airburst munition determines a corrected muzzle velocity via an on board acceleration sensor and processor and corrects an airburst time, accordingly. Velocity calculations are made in real time which allows for timely update of airburst time thereby preventing error stack up due to muzzle velocity variations.

7 Claims, 2 Drawing Sheets

MUZZLE VELOCITY CORRECTION

STATEMENT OF GOVERNMENT INTEREST

The inventions described herein may be manufactured, used and licensed by or for the United States Government.

FIELD OF THE INVENTION

The inventions relates in general to munitions and in particular to airburst munitions.

BACKGROUND OF THE INVENTION

A common function of programmable fuzes is to set an "airburst" location that corresponds to a certain time and/or distance downrange. With target locations ranging out to thousands of meters and beyond, several errors stack up during the round's flight, causing the burst point location to miss the intended target beyond the effective lethal zone of the munition. One of the main contributors to this error stack up is the inability to program an airburst range/time in accordance with each individual round's muzzle velocity since the majority of existing programming techniques occur prior to firing.

Existing methods that do include a muzzle velocity update often require multiple changes to the gun platforms. These include an additional muzzle brake to create a magnetic field, ported gun barrels or multiple sensors installed into the feed systems.

A need exists for the muzzle velocity of a round to be determined more timely and efficiently.

SUMMARY OF INVENTION

One aspect of the invention is a fuze for an airburst munition which adjusts an airburst time based on a corrected muzzle velocity measurement. The fuze comprises an on board acceleration sensor, an on board memory and an onboard processor. The on board acceleration sensor provides a measured acceleration to the on board processor. The on board memory encodes one or more processor-executable instructions. The on board processor is configured to load the one or more processor-executable instructions, which when executed by the processor, cause acts to be performed comprising: receiving a measured acceleration; filtering the measured acceleration to remove noise resulting from setback; numerically integrating the measured acceleration to determine a velocity; and defining a corrected muzzle velocity at an end truncation of the velocity.

A method for adjusting an airburst time of a munition based on a corrected muzzle velocity measurement. The method comprises the steps of: receiving a measured acceleration from an onboard accelerometer; filtering the measured acceleration with a total variation denoising filter to remove noise resulting from setback; numerically integrating the measured acceleration to determine a velocity of the airburst munition; defining a corrected muzzle velocity at an end truncation of the velocity; and updating the airburst location based on the corrected muzzle velocity.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A fuze for an airburst munition determines a corrected muzzle velocity via an on board acceleration sensor and processor and corrects an airburst time, accordingly. Velocity calculations are made in real time which allows for timely update of airburst time thereby preventing error stack up due to muzzle velocity variations. Preliminary testing shows that the corrected muzzle velocity may be obtained within 500 milliseconds and reduces muzzle velocity error by over thirty percent.

Advantageously, the round requires no modification to the weapon system as was necessary in previous solutions. Further, the data obtained from the acceleration sensor is numerically integrated thereby providing a calculated value for velocity.

In contrast to conventional wisdom, the data is integrated via numerical integration by a central processing unit. Conventionally, on-board velocity determinations for other purposes, such as arming, were performed via analog signal processing techniques due to time constraints and the simple nature of information required for those purposes. However, as shown and described herein, the inventors were able to implement a processor-based solution within acceptable time constraints. Testing performed demonstrated that muzzle velocity may be determined within 500 ms.

By employing a processor-based solution, the corrected muzzle velocity may be employed in airburst setting algorithms. The round calculates a corrected muzzle velocity compared to simply comparing a signal value to make a binary determination. Upon determining the corrected muzzle velocity, the corrected muzzle velocity may be compared, such as in a lookup table, to an expected muzzle velocity given the operational conditions such as temperature. Such as solution provides flexibility and scalability.

Figure 1:
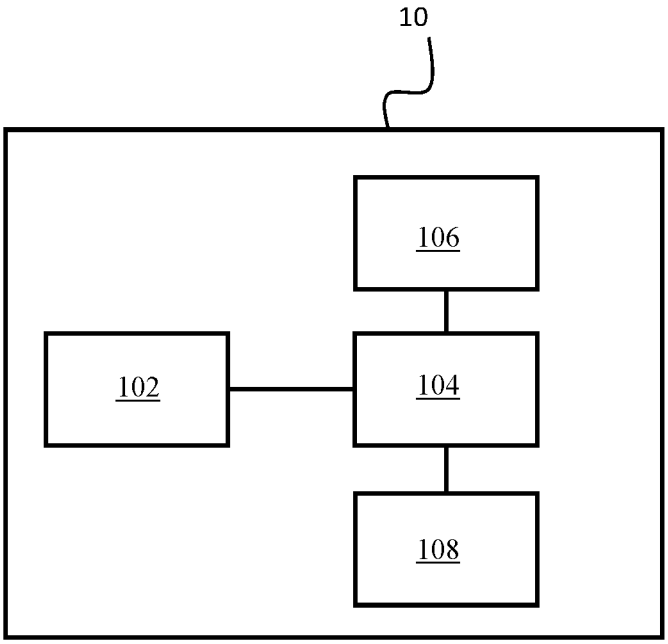
FIG. 1 is a block diagram representing a fuze for a medium caliber airburst munition with an onboard accelerometer, according to one illustrative embodiment.

FIG. 1 is a block diagram representing a medium caliber airburst munition fuze with an onboard accelerometer, according to one illustrative embodiment. Throughout this specification, the airburst munition fuze will be described in the context of a medium caliber 30 millimeter (mm) munition. However, the munition fuze is not limited to a medium caliber munition fuze. The airburst munition fuze may be for any munition of a higher or lower caliber. Further, the determination of muzzle velocity using on board components may translate to non-munition applications including impact sensing in sports and automotive industries or other similar applications where it desirable to determine the velocity of an object.

The airburst munition fuze 10 comprises an acceleration sensor 102, a central processing unit 104, a main memory 106 and nonvolatile memory 108. The acceleration sensor 102, such as an accelerometer, outputs a signal corresponding to a measured velocity to the central processing unit. The acceleration sensor 102 is mounted within the fuze 10 housing. Unlike accelerometers which are employed on munitions for safe and arming purposes, the accelerometer 102 is selected to be precise and not just provide duration and peak of setback. For the purposes required here, the accelerometer must be more precise and importantly, must survive gun launch while still providing a clean signal.

The airburst munition includes at least one central processing unit (CPU) 104. For example, the CPU 104 may represent one or more microprocessors, and the microprocessors may be "general purpose" microprocessors, a combination of general and special purpose microprocessors, or application specific integrated circuits (ASICs). Additionally or alternatively, the CPU 104 may include one or more reduced instruction set (RISC) processors, video processors, or related chip sets. The CPU 104 may provide processing capability to filter received acceleration data, integrate received acceleration data and determine a corrected muzzle velocity from the filtered and integrated acceleration data. The processor is configured to determine the corrected muzzle velocity according to one or more algorithms as will be described more fully below.

A main memory 106 may be communicably coupled to the CPU 104, which may store data and executable code. The main memory 106 may represent volatile memory such as RAM, but may also include nonvolatile memory, such as read-only memory (ROM) or Flash memory. In buffering or caching data related to operations of the CPU 104, the main memory may store data associated with programs being executed by the CPU.

The munition includes nonvolatile storage 108. The nonvolatile storage 108 may represent any suitable nonvolatile storage medium, such as a hard disk drive or nonvolatile memory, such as Flash memory. Being well-suited to long-term storage, the nonvolatile storage 116 may store data files and software (e.g., for implementing functions on the fuze 10).

Figure 2:
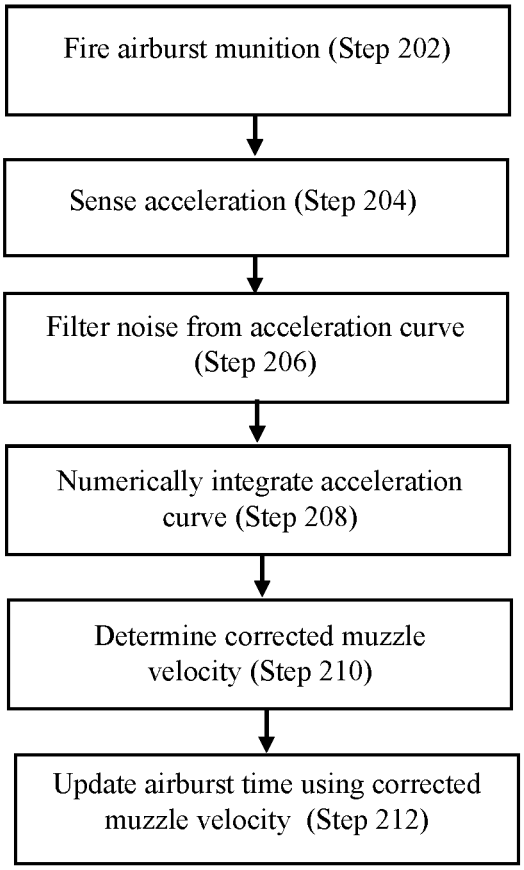
FIG. 2 is a flowchart illustrating a method for determining the muzzle velocity of an airburst munition with an onboard accelerometer, according to one illustrative embodiment of the invention.

FIG. 2 is a flowchart illustrating a method for determining the corrected muzzle velocity of an airburst munition with an onboard accelerometer, according to one illustrative embodiment of the invention.

In step 202, the airburst is fired from the munition with an initial airburst time. The initial airburst time may be based on numerous factors including an expected muzzle velocity and an expected distance to target.

In step 204, the acceleration of the munition is sensed by an on-board acceleration sensor 102 and an acceleration curve of the munition is stored.

In step 206, the acceleration curve is filtered to remove noise resulting from setback. The acceleration data is filtered once acceleration has ceased, about muzzle exit. In one embodiment, a total variation de-noising (TVD) filter is used to filter the acceleration. The TVD filter is capable of removing large amounts of noise potentially seen in the ringing of electronics during setback, while still preserving the edges and finer details of the overall data. The TVD filter is used prior to integration of the data so that a smooth curve with no signal shift can be used as an input. While TVD filters are traditionally employed to sharpen video or digital imagery, the TVD filter may be manipulated and simplified to yield a smooth signal without requiring too much processing.

In step 208, the filtered acceleration data is numerically integrated to obtain velocity data. The numerical integration may be done using a numerical integration method such as a trapezoidal method, Simpson's ⅓rd rule method and Simpson's ⅜th rule method.

In step 210, a corrected muzzle velocity is determined by defining an end truncation of the velocity data. In one embodiment, the velocity data is truncated according to a preset cutoff time or present number of code iterations to define an average muzzle exit distance for all rounds. Alternatively, muzzle velocity may be defined through a double integration of the filtered accelerometer data to determine a position of the round in real time. This position data is matched against a known tube length of the gun to determine the muzzle exit for each individual round.

In step 212, an airburst location is updated using the corrected muzzle velocity. The corrected muzzle velocity is compared to the expected muzzle velocity at the given operational conditions and the airburst time is corrected. The airburst location may be updated via a lookup table comparing airburst time to corrected muzzle velocity.

While the invention has been described with reference to certain embodiments, numerous changes, alterations and modifications to the described embodiments are possible without departing from the spirit and scope of the invention as defined in the appended claims, and equivalents thereof.

What is claimed is:

1. An airburst munition fuze which adjusts an airburst location based on a corrected muzzle velocity measurement, the airburst munition fuze comprising:

an on board acceleration sensor for providing a measured acceleration;

an on board memory encoding one or more processor-executable instructions; and an on board processor configured to load the one or more processor-executable instructions, which when executed by the processor, causes acts to be performed comprising:

receiving the measured acceleration;

filtering the measured acceleration to remove noise resulting from a setback event;

numerically integrating the measured acceleration to determine a velocity of the airburst munition;

determining a corrected muzzle velocity by defining an end truncation of the velocity.

2. The airburst munition of claim 1 wherein the measured acceleration is filtered using a total variation de-noising filter.

3. The airburst munition of claim 1 wherein the end truncation of velocity is defined at a predetermined time.

4. The airburst munition of claim 1 wherein the on board processor configured to load the one or more processor-executable instructions, which when executed by the processor, causes further acts to be performed comprising:

numerically integrating the velocity to determine a position;

matching the position against a known gun tube length to define the end truncation of the velocity.

5. A method for adjusting an airburst location of a munition based on a corrected muzzle velocity measurement, the method comprising the steps of:

receiving a measured acceleration from an on board accelerometer;

filtering the measured acceleration with a total variation de-noising filter to remove noise resulting from a setback event;

numerically integrating the measured acceleration to determine a velocity of the airburst munition;

determining a corrected muzzle velocity by defining an end truncation of the velocity;

updating the airburst location based on the corrected muzzle velocity.

6. The method of claim 5 wherein the step of determining a muzzle velocity by defining an end truncation of the velocity further comprises numerically integrating the velocity to determine a position and matching the position against a known gun tube length to define the end truncation of the velocity.

7. The method of claim 5 wherein the end truncation of the velocity is defined at a preset time.

* * * * *